US007980595B2

(12) United States Patent
Haas et al.

(10) Patent No.: US 7,980,595 B2
(45) Date of Patent: Jul. 19, 2011

(54) POSTAGE LABEL HAVING CONCEALED POSTAL INDICIUM

(75) Inventors: Bertrand Haas, New Haven, CT (US); Jay Reichelsheimer, Shelton, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 12/487,006

(22) Filed: Jun. 18, 2009

(65) Prior Publication Data

US 2009/0252901 A1 Oct. 8, 2009

Related U.S. Application Data

(62) Division of application No. 11/641,145, filed on Dec. 18, 2006.

(51) Int. Cl.
*G09F 3/00* (2006.01)
*B42D 15/10* (2006.01)

(52) U.S. Cl. ..... 283/71; 283/87; 283/94; 235/488; 428/913

(58) Field of Classification Search ..... 283/71, 283/72, 74, 81, 85, 87–89, 91–94, 901, 902; 428/42.1, 690, 913, 915, 916; 235/375, 487, 235/454, 462.06, 494, 488; 40/648
See application file for complete search history.

(56) References Cited

U.S. PATENT DOCUMENTS

| | | | |
|---|---|---|---|
| 4,239,543 | A | 12/1980 | Beasley |
| 5,169,155 | A | 12/1992 | Soules et al. |
| 5,856,048 | A | 1/1999 | Tahara et al. |
| 5,943,432 | A | 8/1999 | Gilmore et al. |
| 6,415,983 | B1 | 7/2002 | Ulvr et al. |

*Primary Examiner* — Shelley Self
*Assistant Examiner* — Pradeep C Battula
(74) *Attorney, Agent, or Firm* — Brian A. Lemm; Charles R. Malandra, Jr.

(57) ABSTRACT

A postage payment label is provided which includes a substrate having an image provided thereon and a postage mark. The substrate and the image are able to transmit light of one or more first wavelengths (e.g., infrared or ultraviolet light) while the postage mark is able to absorb or reflect light of the one or more first wavelengths. Moreover, the image that is provided on the substrate is able to absorb and/or reflect light of one or more second wavelengths (e.g., visible light). Accordingly, when the image is illuminated with light of the one or more second wavelengths (e.g., visible light), the image conceals a portion or all of the postage mark. The postage mark (or relevant portion thereof), however, may be viewed when the image is illuminated with light of the one or more first wavelengths and not illuminated with light of the one or more second wavelengths.

7 Claims, 3 Drawing Sheets

BEFORE APPENDING IMAGE

UNDER NORMAL LIGHT

UNDER W-LIGHT

POSTAGE LABEL HAVING CONCEALED POSTAL INDICIUM

CROSS-REFERENCE TO RELATED APPLICATIONS

This application is a divisional application of prior application Ser. No. 11/641,145, filed Dec. 18, 2006, the specification of which is hereby incorporated by reference.

FIELD OF THE INVENTION

The present invention relates generally to mechanisms for evidencing payment for postage, and in particular to a postage payment label that can conceal all or part of a postal indicium, such as a machine readable two dimensional barcode forming a part of the postal indicium, under certain conditions (e.g., visible light) while allowing the indicium to be viewed/read under other conditions (e.g., infrared or ultraviolet light).

BACKGROUND OF THE INVENTION

The postal services of many countries around the world permit and/or require the printing of postal indicia that include two dimensional barcodes. Such indicia are commonly referred to as Digital Postage Marks (DPM). DPMs typically may include a number of information items in human readable and/or machine readable form, such as, for example, and without limitation, the paid postage amount, the date and time the indicium is generated, the identification number of the postage meter used to generate the indicium, the ascending register value, a postal service symbol, the class of service desired for the mail piece, the addressee ZIP code and/or address, and the sender's name and/or address. For example, the United States Postal Service has implemented a program known as the Information Based Indicia Program (IBIP) which permits the user to generate a postal indicium for sending a mailpiece (e.g., a letter, a package, etc . . . ) that includes a human readable portion and a machine-readable portion in the form of a two dimensional barcode, such as, without limitation, a Data Matrix symbol.

As is known, a two dimensional barcode, such as a Data Matrix symbol, typically consists of a number of data regions having nominally square modules arranged in an array, wherein each module generally represents one bit of data. For a black on white Data Matrix symbol, for instance, a darkened (i.e., filled) module represents a binary "one" and a light (e.g., empty) module represents a binary "zero."

Despite the numerous advantages that are provided by the use of two dimensional barcodes in postal indicia, many individuals find such two dimensional barcode to be aesthetically unpleasing. Accordingly, it would be advantageous to be able to conceal a two dimensional barcode appearing in a postal indicium from individuals under normal conditions while allowing a postal service to view the two dimensional barcode when desired.

SUMMARY OF THE INVENTION

This invention provides an improved postage payment label that is able to conceal a postage mark, such as a DPM, under a first set of conditions (e.g., visible light) while allowing the postage mark to be viewed and/or read under a second set of conditions (e.g., infrared or ultraviolet light).

In accordance with one embodiment of the invention, a postage payment label is provided which includes a substrate, which has an image provided thereon, and a postage mark.

The substrate and the image are able to transmit light of one or more first wavelengths (e.g., infrared or ultraviolet light) while the postage mark is able to absorb or reflect light of the one or more first wavelengths. Moreover, the image that is provided on the substrate is able to absorb and/or reflect light of one or more second wavelengths (e.g., visible light). Accordingly, when the image is illuminated with light of the one or more second wavelengths (e.g., visible light), the image conceals a portion or all of the postage mark. The postage mark (or relevant portion thereof), however, may be viewed when the image is illuminated with light of the one or more first wavelengths and not illuminated with light of the one or more second wavelengths.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DESCRIPTION OF THE PREFERRED EMBODIMENTS

Figure 1:
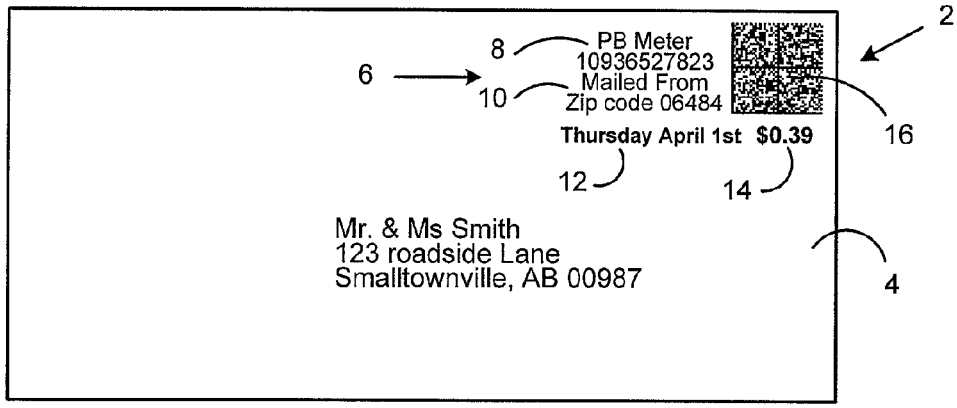
FIG. 1 is a front elevational view of an envelope with a Digital Postage Mark provided thereon.

As used herein, the phrase "a number of" or variations thereof mean one or an integer greater than one. As used herein, the phrase "wavelength" or variations thereof shall broadly refer to a wavelength in the electromagnetic spectrum. For example, the wavelength could be within the infrared region, the visible region, or the ultraviolet region. As used herein, the phrase "image" or variations thereof shall, by way of example and not limitation, include a graphic, cartoon, photo, amount of postage, date, symbol, flag, drawing, decoration, or combinations thereof. Directional phrases used herein, such as, for example, upper, lower, left, right, vertical, horizontal, top, bottom, above, beneath, clockwise, counterclockwise and derivatives thereof, relate to the orientation of the elements shown in the drawings and are not limiting upon the claims unless expressly recited therein.

As noted elsewhere herein, many individuals find two dimensional barcodes which are used in postal indicia to be aesthetically unpleasing. This invention overcomes this shortcoming by providing an improved label that is able to conceal the two dimensional bar code under a first set of conditions while allowing the two dimensional bar code to be viewed and/or read, for example by a postal service, under a second set of conditions.

Figure 2:
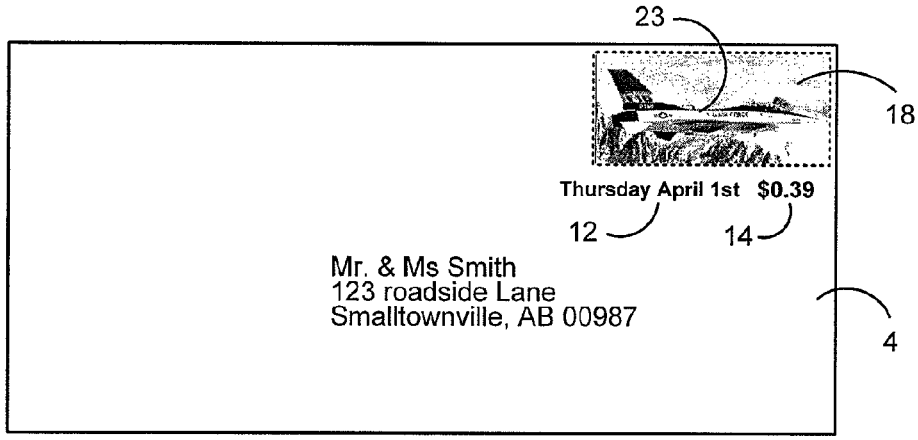
FIG. 2 is a front elevational view of the envelope of FIG. 1 wherein a label according to one embodiment of the invention covers the Digital Postage Mark while being exposed to normal light.

FIGS. 1-4 show a first embodiment of the present invention wherein a digital postage mark (DPM) 2 (FIG. 1) is printed onto a standard letter size envelope 4 using printing techniques that are commonly known in the art (e.g., inkjet printing) and wherein all or part of the DPM 2 is covered by a label 18 (FIG. 2). As seen in FIG. 1, the DPM 2 includes two distinct portions. The first portion is a human readable portion 6 which includes: (i) the serial number 8 of the postage meter that printed the DPM 2, (ii) the zip code 10 from which the envelope 4 is being mailed, (iii) the date 12 on which the DPM 2 was printed onto the envelope 4, and (iv) the postage amount 14. The second portion of the DPM 2 is a machine readable portion 16 which includes a two dimensional barcode which may be, for example, a Data Matrix Symbol. The machine readable portion 16 may include some or all of the information found in the human readable portion 6, in clear text form and encrypted form (e.g., in the form of a digital signature), with the encrypted information being available to be used by the particular postal service in question to authenticate the DPM 2 after the envelope 4 has been inserted into the mail stream. For reasons that will be discussed in greater detail below, the DPM 2 is printed on the envelope 4 using one or more dyes (e.g., inks) that absorb a particular one or more wavelengths of light (hereinafter, referred to as wavelengths W) such as, without limitation, one or more wavelengths that fall within the infrared (IR) and/or ultraviolet (UV) spectrum.

Figure 4:
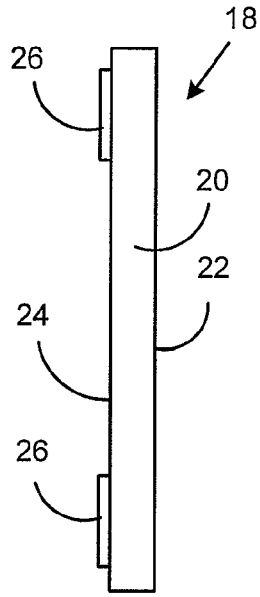
FIG. 4 is a cross sectional view of a label in accordance with one embodiment of the invention.

In this first embodiment of the invention, the label 18, which is described in detail below in connection with FIG. 4, is able to conceal all or a selected part (such as the machine readable portion 16) of the DPM 2 under visible (human) lighting conditions while allowing the concealed portion of the DPM 2 (printed in the dye as described above) to be viewable and/or readable when the label 18 is not illuminated by visible light but instead is illuminated by light of the wavelengths W. In the particular embodiment shown in FIG. 2, the label 18 is positioned over a substantial portion of the DPM 2. Specifically, the label 18 is positioned over the entire DPM 2 except for (i) the date 12 that the DPM 2 was printed onto the envelope 4, and (ii) the postage amount 14.

Referring to FIG. 4, the label 18 according to one particular embodiment includes a substrate 20 having a first surface 22 and a second surface 24. The substrate 20 is made from a material that is transmissive to the one or more wavelengths W (i.e., the one or more wavelengths that are absorbed by the dye or dyes used to print the DPM 2). The first surface 22 of the substrate 20 is the surface (side) of the substrate 20 that faces away from the envelope 4 while the second surface 24 of the substrate 20 is the surface (side) of the substrate 20 that faces towards the envelope 4 when the label 18 is affixed to the envelope as shown in FIG. 2.

Continuing with FIG. 2, printed on the first surface 22 of the substrate 20 is an image 23 that is used to conceal all or part of the DPM 2 as described herein. In the preferred embodiment, the image 23 is printed onto the first surface 22 of the substrate 20 using a dye or dyes that absorb and reflect wavelengths in the visible light spectrum. Accordingly, the image 23 would be clearly visible (to a human) when exposed to light in the visible light spectrum and would thus conceal the covered portions of the DPM 2. This condition is shown in FIG. 2.

Figure 3:
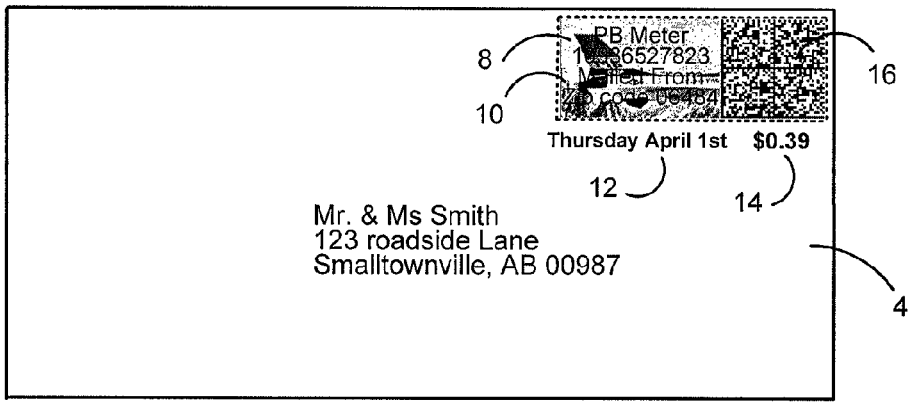
FIG. 3 is a front elevational view of the envelope and label of FIG. 2 while being exposed to light of one or more wavelengths W.

The image 23 may be printed onto the first surface 22 of the substrate 20 using techniques that are commonly known in the art. For example, an ink jet printer may be used to print the image 23 onto the first surface 22 of the substrate 20. Alternatively, dye sublimation or thermal transfer may also be used to create the image 23 on the first surface 22 of the substrate 20. Disposed on the second surface 24 of the substrate 20 is an adhesive 26 that is used to secure the label 18 to the envelope 4 (FIGS. 2 and 3). It should be noted that in other embodiments, a protective covering (not shown), which can be separated from the adhesive 26 thereby exposing the adhesive 26, may be disposed over the adhesive 26 in order to prevent the substrate 20 from being applied to an object other than the envelope 4 or the package that is being mailed.

In addition, the dye or dyes used to print the image 23 onto the substrate 20 not only absorb and/or reflect visible light, but it or they, as the case may be, transmit light of the one or more wavelengths W. For example, the dye or dyes used to print the image 23 could absorb and/or reflect wavelengths in the visible light spectrum while being transmissive to one or more wavelengths either in the infrared spectrum and/or the ultraviolet spectrum. Therefore, the label 18 and the image 23 that is printed on the first surface 22 of the substrate 20 would appear substantially transparent when illuminated by wavelengths that fall within the infrared and/or ultraviolet spectrum while not also being illuminated by visible light.

Referring to FIG. 3, this figure depicts the label 18 when the label 18 is being exposed to light of the one or more wavelengths W. As stated above, the dye or dyes used to print the image 23 are transmissive to light of the one or more wavelengths W which, for example, could be one or more wavelengths that fall within the infrared and/or ultraviolet spectrum. Because the printed image 23 is transmissive to light of the one or more wavelengths W, the label 18 in FIG. 3 appears substantially transparent when it is exposed to light of the one or more wavelengths W. Therefore, the DPM 2, which, in the embodiment described above, is printed from a dye that absorbs light of the one or more wavelengths W, can be viewed and/or read, such as by the particular postal service in question, through the label 18 when the label 18 is exposed to light of the one or more wavelengths W while not being simultaneously illuminated by visible light.

Furthermore, in order to increase the viewability of the DPM 2 when the label 18 is exposed to light of the one or more wavelengths W as just described, the envelope 4 is preferably made from a material and/or is of a color that is reflective of light of the one or more wavelengths W, thereby increasing the contrast between the envelope 4 and the DPM 2 that is printed on the envelope 4. For instance, the envelope 4 may be manufactured from white paper while the DPM 2 may be printed onto the envelope 4 using a carbon black based ink or a non-black ink which absorbs wavelengths in the infrared and/or ultraviolet spectrum. Alternatively, the envelope 4 may be coated with a coating, such as, for example, any suitable optical brighteners, which enhances the reflectivity of the envelope 4 to wavelengths in the infrared and/or ultraviolet spectrum.

Moreover, in an alternative embodiment, the DPM 2 is printed onto the envelope 4 using a dye that is reflective of light of the one or more wavelengths W. In this case, it would be preferable for the envelope 4 to be made from a material and/or be of a color that is absorbent of light of the one or more wavelengths W in order to provide the contrast between the DPM 2 and the envelope 4.

Figure 5B:
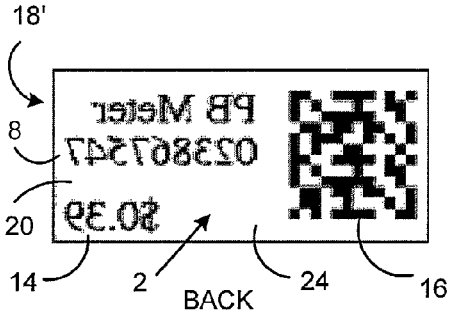
FIGS. 5A-5D show a label according to one alternative embodiment of the invention.
Figure 5A:
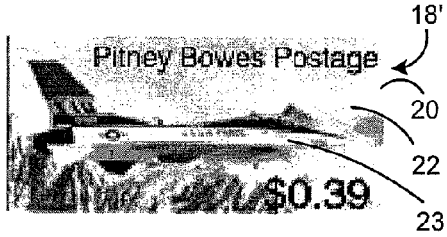
Figure 5C:
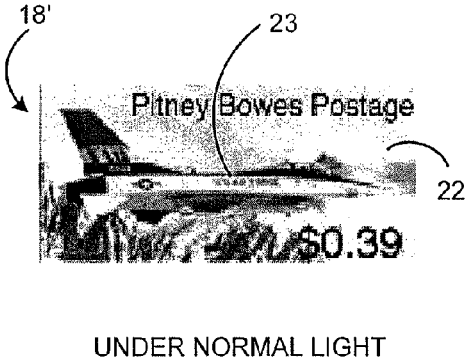
Figure 5D:
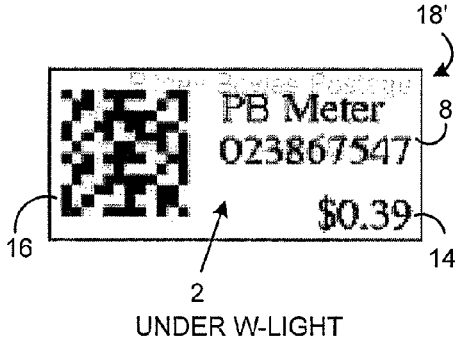

FIGS. 5A-5D show a label 18' according to a second, alternative embodiment of the present invention. Specifically, FIG. 5A is a front view of the label 18', FIG. 5B is a back view of the label 18', FIG. 5C shows the label 18' when illuminated by visible light, and FIG. 5D shows the label 18' when illuminated not by visible light, but instead by light of the one or more wavelengths W. As seen in FIGS. 5A and 5B, the label 18' includes a substrate 20 made of a material that is transmissive to the one or more wavelengths W and that includes a first surface 22 and a second surface 24. In addition, as seen in FIG. 5A, an image 23 having the properties described elsewhere herein is printed on the first surface 22. Furthermore, as seen in FIG. 5B, in the label 18', a DPM 2 is printed directly onto the second surface 24 of the substrate 20 by, for example, a postage meter or mailing machine into which the label 18' is fed. In particular, the DPM 2 is printed as a reverse image 23 (see FIG. 5B) so that when the label 18' is applied to the envelope 4, such as in a manner described below, the DPM 2 would appear in the "correct" orientation when the label 18' is exposed to the one or more wavelengths W (see FIG. 5D). As will be appreciated, as described elsewhere herein, the DPM 2 will be concealed by the image 23 when exposed to visible light as shown in FIG. 5C.

The label 18' may be applied to the envelope 4 in a number of ways. For example, an adhesive, such as a glue, may be applied on top of all or a portion of the second surface 24 before applying the label 18' to the envelope 4. Alternatively, the position of the second surface 24 on which the DPM 2 is to be printed may be surrounded by an adhesive border covered by a protective sheet. After the DPM 2 is printed, the protective sheet may then be peeled off and the label 18' may be applied to the envelope 4. In still a further alternative, a thermo-sensitive dye of the type used in thermal papers may be embedded in an adhesive applied on the second surface 24 in which the DPM 2 is to be printed. This may be done at the time of stock manufacturing described below. A thin heat conductive protective sheet may then be applied over the adhesive. A thermal printer may then be used to print the DPM 2 on the second surface 24 as described above. The thermal printer would print through the protective sheet by turning the dye in the adhesive black as is the case with thermal paper. The protective sheet would then be peeled off so the label 18' can be applied to the envelope 4. Additionally, if the adhesive covers a substantial portion of the second surface 24 of the substrate 20, then the adhesive, which would be disposed over the printed DPM 2, may be made from a material that can either transmit or reflect the one or more wavelengths W. A transmissive adhesive would be useful in situations where the envelope 4 is made from a material that is reflective of the one or more wavelengths W which, as stated above, increases the visibility of the DPM 2. A reflective adhesive would be useful in situations where the envelope 4 is not made from a material that is reflective of the one or more wavelengths W and, therefore, the adhesive would be used to increase the visibility of the DPM 2 in lieu of the envelope 4.

In one particular embodiment of the invention, a mailer may provide (e.g., upload) a uniform image 23 to a third party service provider facility where it is embedded in a substrate 20 as shown in FIG. 5A in a quantity chosen by the mailer in order to make a stock of labels 18' on which DPMs 2 may later be printed as shown in FIG. 5B. The stock is then delivered to the mailer by the third party. The mailer may then load the stock of labels 18' into his or her postage meter or mailing machine and may then selectively print DPMs 2 onto the labels 18' in the manner shown in FIG. 5B. Optionally, for the convenience of users and for easy direct verification by a postal carrier/worker, the postage amount may be printed on the front of the label 18'. Alternatively, a small window can be left transparent on the stock at the position where the postage amount will be printed in the DPM 2 so that it can be seen through the front of the label 18' in normal, visible light.

Figure 6A:
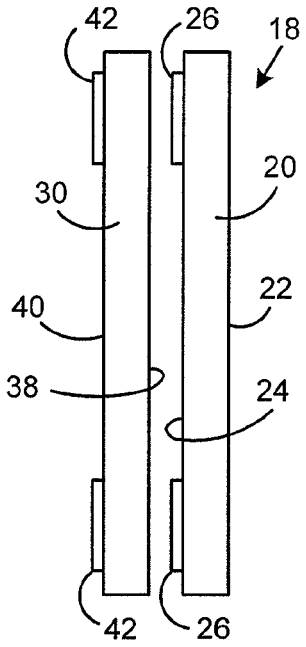
FIGS. 6A and 6B show a cross sectional view of a label and substrate in accordance with another embodiment of the invention.
Figure 6B:
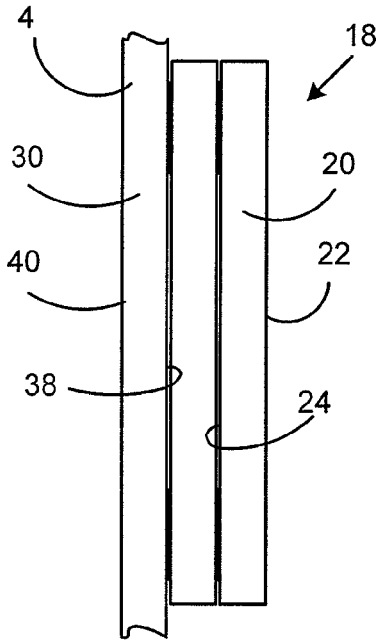

FIGS. 6A and 6B depict another embodiment of the invention in which the DPM 2 is printed on a first surface 38 of a substrate 30 using a dye that absorbs light of the one or more wavelengths W. The substrate 30 is made from a material that is reflective of light of the one or more wavelengths W, and may be, for example, a label made of an appropriate material. Unlike the embodiment that is depicted in FIGS. 5A-5D, the DPM 2 in this embodiment would not be printed as a reverse image since the DPM 2 is not being printed on the second surface 24 of the label 18'. Disposed on the second surface 40 of the substrate 30 is an adhesive 42 that is used to secure the substrate 30 to the envelope 4. After the substrate 30 having the DPM 2 printed thereon is affixed to the envelope 4, a label 18 (as described elsewhere herein) may be affixed to the envelope 4 on top of the substrate 30 in order to conceal all or part of the DPM 2. Because the image 23 on the label 18 is visible under visible light conditions, an individual viewing the envelope 4 under normal light conditions would not be able to see the DPM 2 (or portion thereof) that is covered by the label 18 since the label 18 would appear opaque. If, however, an individual or a postal service would like to view the DPM 2 (printed on the substrate 30), then the individual or postal service would expose the label 18 to light of the one or more wavelengths W, thereby allowing the DPM 2 to become visible as described elsewhere herein. Once visible, the DPM 2 could then be examined and/or scanned as needed.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A postage payment label for evidencing payment of postage comprising:

a substrate, said substrate transmitting light of one or more first wavelengths outside of a human visible spectrum of light; said substrate having a first surface and a second surface opposite said first surface;

an image provided on said first surface of said substrate, said image being generated using one or more first dyes that transmit said light of one or more first wavelengths and at least one of absorb and reflect light of one or more second wavelengths inside of said human visible spectrum of light; and a postage mark printed as a reverse image on said second surface of said substrate, said postage mark providing evidence of postage payment and being printed with one or more second dyes that either absorb or reflect said light of one or more first wavelengths;

wherein said image conceals at least a portion of said postage mark when said image is illuminated substantially by said light of one or more second wavelengths, and wherein said at least a portion of said postage mark is not concealed by said image and may be viewed when said image and said at least a portion of said postage mark are substantially illuminated by said light of one or more first wavelengths.

2. The postage payment label according to claim 1, wherein said light of one or more first wavelengths is at least one of infrared light and ultraviolet light.

3. The postage payment label according to claim 1, wherein said one or more second dyes absorb said light of one or more first wavelengths and wherein said postage mark is provided against a background that reflects said light of one or more first wavelengths.

4. The postage payment label according to claim 1, wherein said one or more second dyes reflect said light of one or more first wavelengths and wherein said postage mark is provided against a background that absorbs said light of one or more first wavelengths.

5. The postage payment apparatus according to claim 1, wherein said postage mark is a digital postage mark having a human readable portion and a machine readable portion, said at least a portion of said postage mark including said machine readable portion.

6. The postage payment apparatus according to claim 1, wherein said one or more second dyes is a carbon black based dye.

7. The postage payment apparatus according to claim 1, wherein said one or more second dyes is a non-black dye.

* * * * *